US006220730B1

(12) United States Patent
Hewlett et al.

(10) Patent No.: US 6,220,730 B1
(45) Date of Patent: Apr. 24, 2001

(54) ILLUMINATION OBSCUREMENT DEVICE

(75) Inventors: William Hewlett, Birmingham; Nigel Evans, West Midlands, both of (GB)

(73) Assignee: Light & Sound Design, Ltd., Birmingham (GB)

( * ) Notice: Subject to any disclaimer, the term of this patent is extended or adjusted under 35 U.S.C. 154(b) by 0 days.

(21) Appl. No.: 09/108,263

(22) Filed: Jul. 1, 1998

(51) Int. Cl.[7] ..... F21V 7/00

(52) U.S. Cl. ..... 362/297; 362/257; 362/276; 362/277; 362/282; 362/303; 345/31; 348/98; 348/743; 352/40; 352/41; 352/89; 352/208; 352/212; 353/88; 353/97

(58) Field of Search ..... 362/257, 276, 362/277, 282, 297, 303; 353/98, 88, 97; 352/40, 41, 89, 208, 212; 348/88, 97, 98, 742, 743, 771; 345/31

(56) References Cited

U.S. PATENT DOCUMENTS 1,865,186 * 6/1932 Harris, Jr. ..... 352/208
5,379,083 * 1/1995 Tomita ..... 353/122
5,541,679 * 7/1996 Yang ..... 353/98
5,668,611 * 9/1997 Ernstoff et al. ..... 348/771

* cited by examiner

*Primary Examiner*—Cassandra C. Spyrou
*Assistant Examiner*—Craig Curtis
(74) *Attorney, Agent, or Firm*—Fish & Richardson P.C.

(57) ABSTRACT

An illumination obscurement device for controlling the obscurement of illumination from a light source which is optimized for use with a rectangular, arrayed, selective reflection device. In a preferred embodiment, a rotatable shutter with three positions is placed between a light source and a DMD. The first position of the shutter is a mask, preferably an out of focus circle. This out of focus circle creates a circular mask and changes any unwanted dim reflection to a circular shape. The second position of the shutter is completely open, allowing substantially all the light to pass. The third position of the shutter is completely closed, blocking substantially all the light from passing. By controlling the penumbra illumination surrounding the desired illumination, DMDs can be used in illumination devices without creating undesirable rectangular penumbras.

11 Claims, 11 Drawing Sheets

ILLUMINATION OBSCUREMENT DEVICE

TECHNICAL FIELD

The present disclosure describes a special image obscurement device for a light source.

BACKGROUND

In live dramatic performances controlled lighting is often used to illuminate a performer or other item of interest. The illuminated area for live dramatic performance is conventionally a circular beam of light called a "spot light." This spot light has been formed from a bulb reflected by a spherical, parabolic, or ellipsoidal reflector. The combination forms a round beam due to the circular nature of reflectors and lenses.

The beam is often shaped by gobos. FIG. 1 shows a light source 100 projecting light through a triangular gobo 108 to the target 105. The metal gobo 108 as shown is a sheet of material with an aperture 110 in the shape of the desired illumination. Here, that aperture 110 is triangular, but more generally it could be any shape. The gobo 108 restricts the amount of light which passes from the light source 100 to the imaging lenses 103. As a result, the pattern of light 106 imaged on the stage 105 conforms to the shape of the aperture 110 in the gobo 108.

Light and Sound Design, the assignee of this application, have pioneered an alternate approach of forming the gobo from multiple selected reflective silicon micromirrors 200. One such array is called a digital mirror device ("DMD") where individual mirrors are controlled by digital signals. See U.S. Pat. No. 5,828,485 (application Ser. No. 08/598,077) and application Ser. No. 09/145,314, the disclosures of which are herein incorporated by reference. DMDs have typically been used for projecting images from video sources. Because video images are typically rectangular, the mirrors of DMDs are arranged in a rectangular array of rows and columns.

The individual mirrors 200 of a DMD are rotatable. Each mirror 200 is mounted on a bar 204 such that it can rotate in place around the axis formed by the bar 204. Using this rotation, individual mirrors 200 can be turned "on" and "off" to restrict the available reflective surface.

FIG. 2 shows an example of using a DMD 400 to project a triangular illumination by turning "off" some of the mirrors in the DMD 400. The surface of the DMD 400 exposed to a light source 402 comprises three portions. The individual mirrors which are turned "on" (toward the light source 402) make up an active portion 404. In FIG. 4A, the active portion 404 is triangular. The individual mirrors which are turned "off" (away from the light source 402) make up an inactive portion 406. These pixels are reflected. The third portion is a surrounding edge 408 of the DMD 400. Each of these portions of the DMD 400 reflects light from the light source 402 to different degrees.

FIG. 3 shows a resulting illumination pattern 410 with the active area 404 inactive area 406 and cage 408.

SUMMARY

The inventors recognize that light reflected from the inactive portion 406 of the DMD 400 generates a dim rectangular penumbra 418 area is surrounding the bright desired area 404. Light reflected from the edge 408 of the DMD 400 generates a dim frame area. The inventors recognized that this rectangular penumbra 418 is not desirable.

The inventors also recognized that a circular penumbra is much less noticeable in the context of illumination used in dramatic lighting.

Accordingly the inventors have determined that it would be desirable to have a device which would provide a circular illumination without a rectangular penumbra while using a rectangular arrayed device as an imaging surface. The present disclosure provides such capabilities.

This disclosure describes controlling illumination from a light source. The disclosed system is optimized for use with a rectangular, arrayed, selective imaging device.

In a preferred embodiment, a rotatable shutter with three positions is placed between a DMD and the imaging optical system. The first position of the shutter is a mask, preferably a circle, placed at a point in the optical system to be slightly out of focus. This circle creates a circular mask and changes any unwanted dim reflection to a circular shape. The second position of the shutter is completely open, allowing substantially all the light to pass. The third position of the shutter is completely closed, blocking substantially all the light from passing.

An alternate embodiment for blocking the rectangular penumbra by changing any penumbra to round uses an iris shutter placed between a DMD and increases optics. The iris shutter creates a variable aperture which ranges from completely closed to completely open. Intermediate settings include circles of varying diameter, resulting in similar projections as with the first position of the shutter embodiment.

Another alternate embodiment for blocking the rectangular penumbra by changing any penumbra to round uses two reflective surfaces. The first reflective surface is a DMD. The second reflective surface is preferably a light-sensitive reflective surface such as a polymer. If the light striking a portion of the reflective surface is not sufficiently bright, that portion will not reflect the full amount of that light.

By controlling the penumbra illumination surrounding the desired illumination, DMDs and other pixel-based rectangular elements can be used in illumination devices without creating undesirable rectangular penumbras.

DETAILED DESCRIPTION

The structure and operational parameters of preferred embodiments will be explained below making reference to the drawings.

The present system uses two different operations to minimize the viewable effect of the unintentional illumination, or penumbra, discussed previously. A first operation forms the optics of the system in a way which prevents certain light from being focused on the DMD and hence prevents that light from being reflected. By appropriately masking the incoming light to the DMD, certain edge portions of the penumbra can be masked. A second part of the system uses a special illumination shutter to provide different shaped penumbras when desired.

Figure 4:
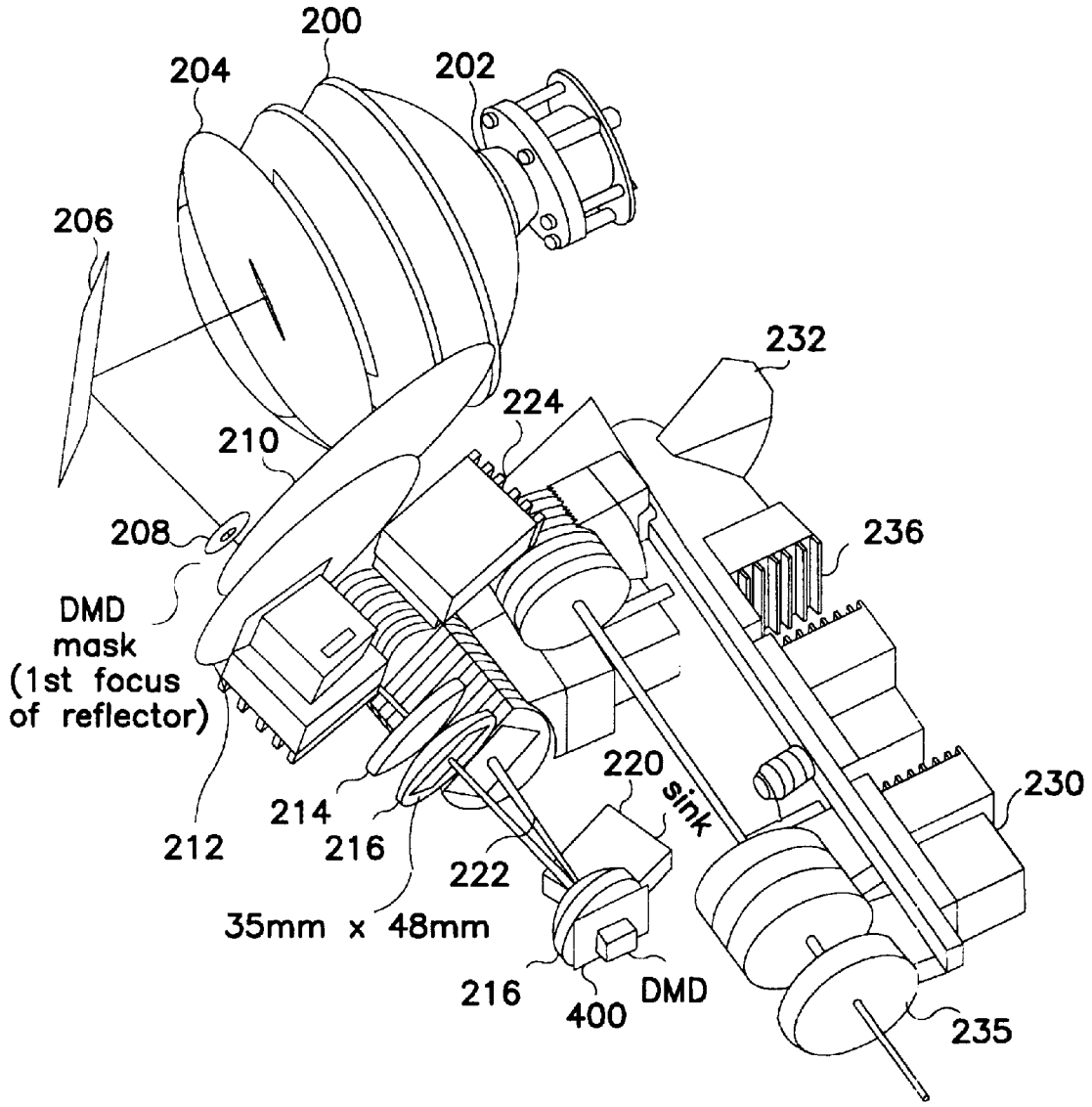
FIG. 4 show the optical train.

The overall optical system is shown in FIG. 4. The bulb assembly 200 includes a high wattage bulb, here an MSR 1200 SA Xenon bulb 202 and retroreflectors 204 which capture some of the output from that bulb. The output of the bulb is coupled to a dichroic or "cold" mirror 206 which reflects the visible light while passing certain portions of the infrared. The first focus of the reflector is at Point 208. A DMD mask is located at that point. The DMD mask is preferably rectangular, and substantially precisely the shape of the inner area 418 of the DMD. The image of the mask is also focused onto the DMD: such that if one were looking at the mask from the position of the DMD, one would see the mask clearly and in focus.

A first color system includes an RGB system 210 and a parametric color system 212. The light passes through all of these elements and is then further processed by an illumination relay lens 214 and then by an imaging relay lens 216. The image relay lens 216 has an aperture of 35 millimeters by 48 millimeters. The output is focused through a field lens 216 to the DMD 400. The off pixels are coupled to heat sink 220, and the on pixels are coupled via path 222 back through the imaging relay 216 folded in the further optics 224 and finally coupled to zoom elements 230. The zoom elements control the amount of zoom of the light beam. The light is colored by a designer color wheel 232 and finally focused by a final focus element 235.

Figure 3A:
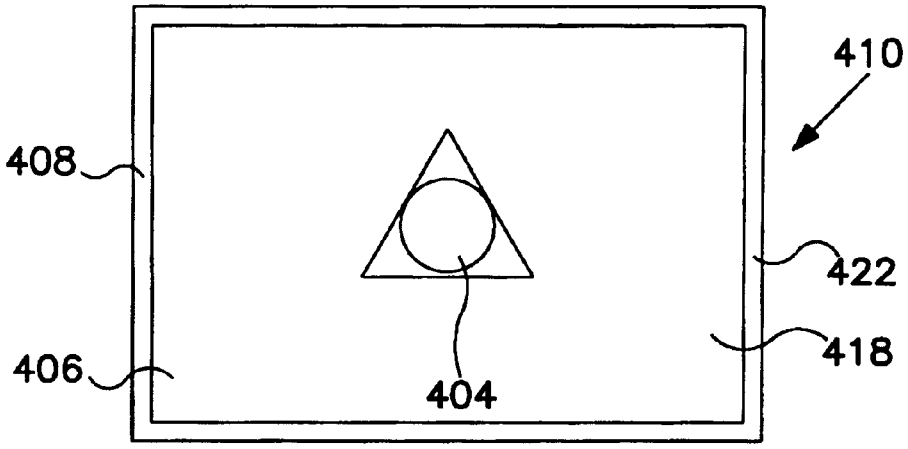
FIG. 3A PRIOR ART
FIG. 3A–3G shows a illumination patterns.

The way in which the outer penumbra is removed will be explained with reference to FIGS. 3A and 4B.

Figure 3B:
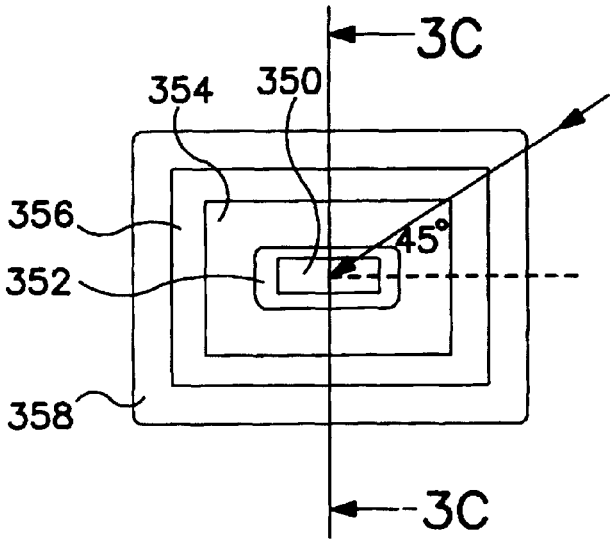

FIG. 3B shows the front surface of the DMD. This includes a relatively small inner active portion 350 which includes the movable mirrors. Active portion 350 is surrounded by a white inactive portion 352 which is surrounded by packaging portion 354, a gold package 356, and a ceramic package 358. Light is input at a 20° angle from the perpendicular. The reason why becomes apparent when one considers FIG. 3C. The mirrors in the DMD tip by 10°.

Figure 3C:
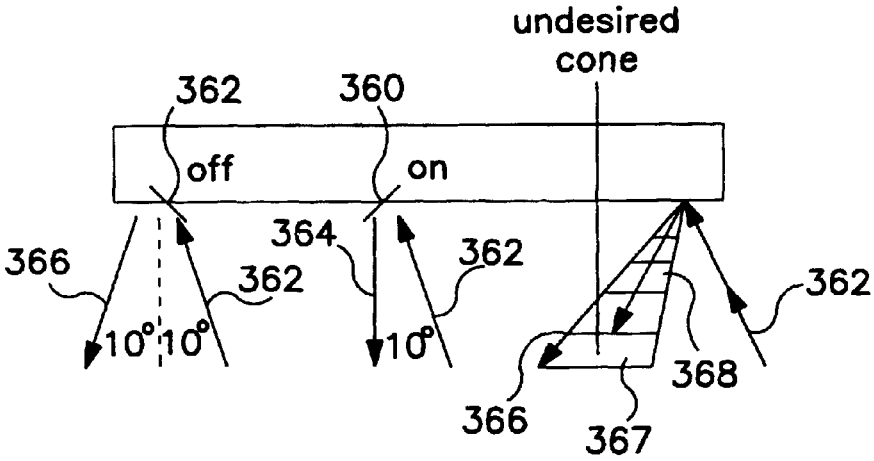

FIG. 3C shows two exemplary mirrors, one mirror 360 being on, and the other mirror 362 being off. Input light 362 is input at a 20° angle. Hence, light from the on mirror emerges from the DMD perpendicular to its front surface shown as 364. However, the same light 362 impinging on an off mirror emerges at a different angle shown as 366. The difference between those two angles forms the difference between undesired light and desired light. However, note in FIG. 3C what happens when the incoming light 362 hits a flat surface. Note the outgoing beam 368 is at a different angle than either the off position or the on position. The hypothetical beam 366 from an off mirror is also shown.

Figure 1:
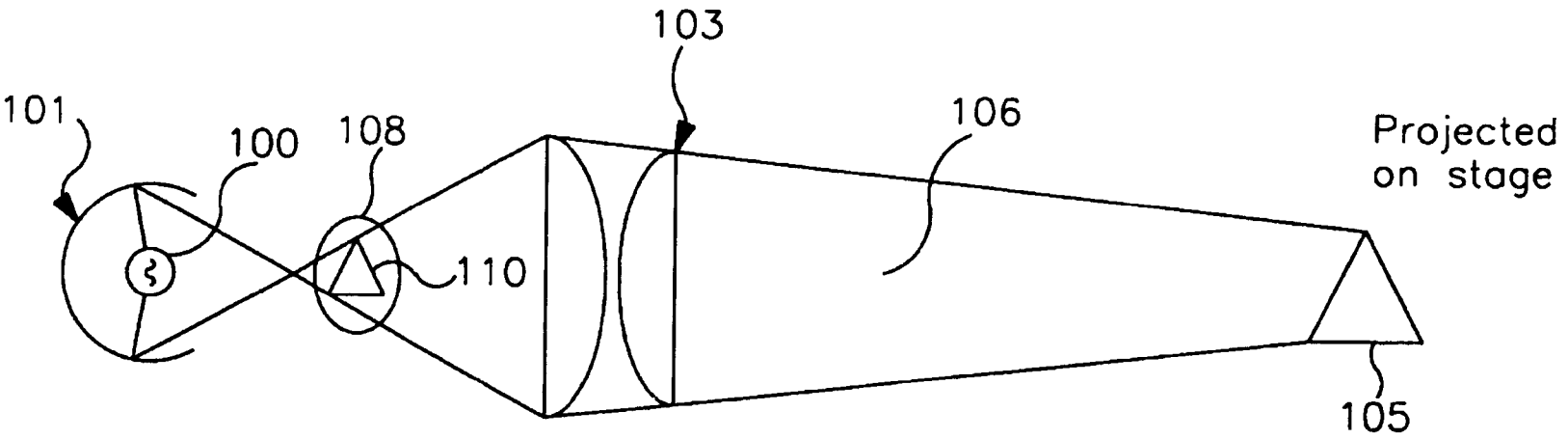
FIG. 1 shows a conventional illumination device including a gobo.
Figure 2:
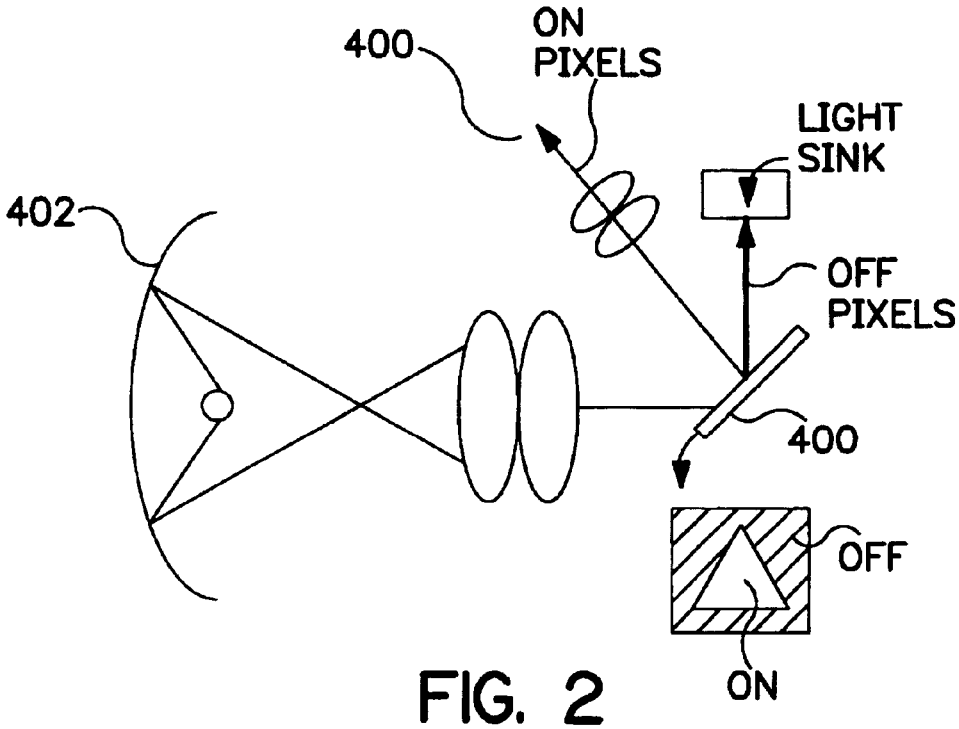
FIG. 2 PRIOR ART
FIG. 2 shows an illumination device including a DMD.
Figure 3D:
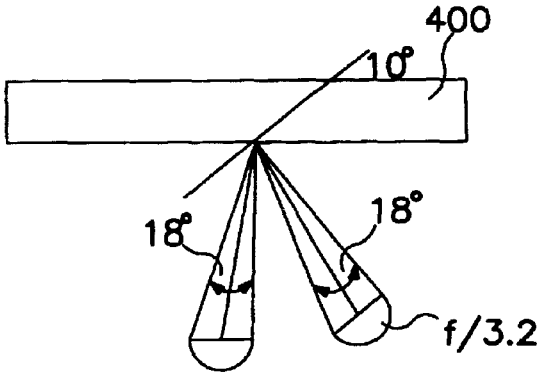

The inventors recognize, therefore, that a lot of this information falls within an undesired cone of light. All light which is input (e.g. 362 rays can be filtered by removing the undesired cone. This is done according to the present disclosure by stopping down the cone of light to about 18° on each side. The final result is shown in FIG. 3D. The incoming light is stopped down to a cone of 18° by an FIG. 2 lens. The incoming light is coupled to the surface of the DMD 400, and the outgoing light is also stopped to a cone of 18°. These cones in the optical systems are identified such that the exit cone does not overlap with the undesired cone 367 shown in FIG. 3C.

Figure 3E:
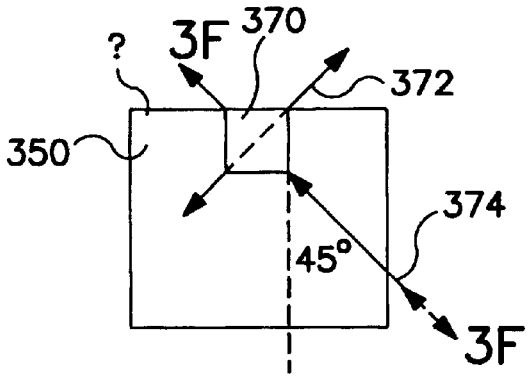
Figure 3F:
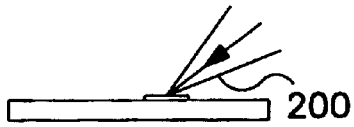
Figure 3G:
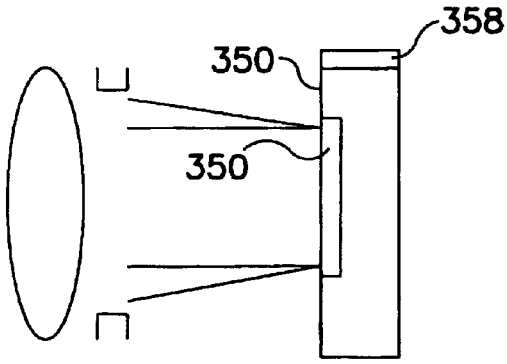

This operation is made possible by appropriate two-dimensional selection of the incoming light to the digital mirror. FIG. 3E shows the active portion 350 of the digital mirror. Each pixel is a rectangular mirror 370, hinged on axis 372. In order to allow use of this mirror and its hinge, the light needs to be input at a 45° angle to the mirror, shown as incident light ray 374. The inventors recognized, however, that light can be anywhere on the plane defined by the line 374 and perpendicular to the plane of the paper in FIG. 3E. Hence, the light of this embodiment is input at the 45° angle shown in FIG. 3E and also at a 20° angle shown in FIG. 3F which represents a cross section along the line 3F–3F. This complex angle enables using a plane of light which has no interference from the undesired portions of the light. Hence, by using the specific desired lenses, reflections of random scattered illumination is bouncing off the other parts is removed. This masking carried out by at least one of the DMD mask 208 and the DMD lens 216. By appropriate selection of the input light, the output light has a profile as shown in FIG. 3G. 350 represents the DMD active area, 356 represents the border, and 358 represents the mount. The light output is only from the DMD active area and is stopped and focused by appropriate lenses as shown in FIG. 3G.

Figure 5:
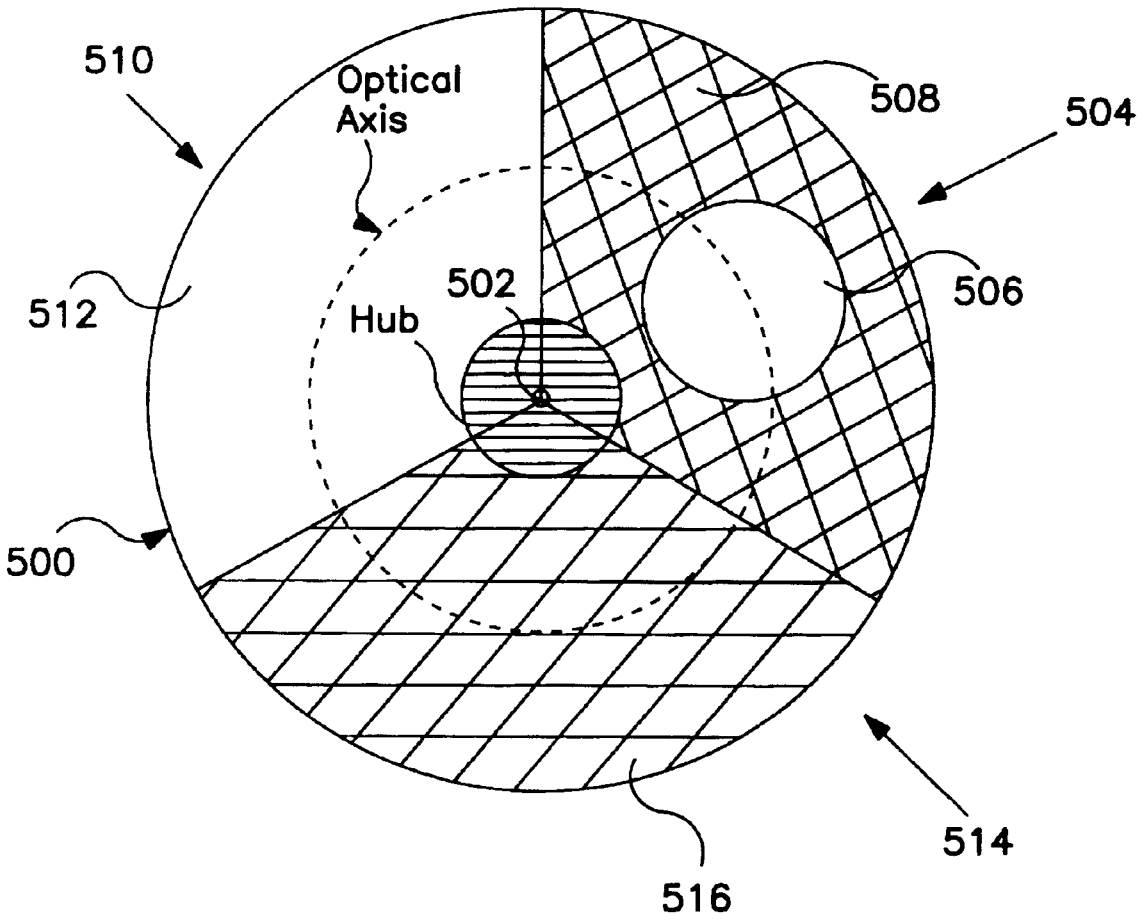
FIG. 5 shows a three position shutter according to a preferred embodiment of the present invention.

FIG. 5 shows a planar view of a shutter 500 according to a preferred embodiment of the invention. The preferred configuration of the shutter 500 is a disk divided into three sections. Each section represents one position to which the shutter 500 may be set. The shutter 500 is preferably rotated about the center point 502 of the shutter. The gate of the light is off center, to allow it to interact with one of the three sections. Rotation is preferred because rotation allows efficient transition between positions. Alternately, the shutter 500 may slide vertically or horizontally to change from one position to another. A round shape is preferred because of efficiency in material and space use. Alternately, the shutter 500 may be rectangular or some other polygonal shape.

Three positions are preferred because each position is rotatably equidistant from the other positions. However, a shutter 500 with three positions provides more positions than a shutter 500 with only two positions.

In a preferred embodiment, a first position is a mask position 504. The mask position 504 includes an open or transparent aperture 506 and an opaque mask portion 508 which is not permeable to light. Preferably, material is removed from the shutter 500 leaving a shaped aperture 506 and a mask portion 508.

The second position is an open position 510. The open position 510 includes an opening 512. Preferably the opening 512 is formed by removing substantially all material from the shutter 500 in the section of the open position 510.

The third position is a closed position 514. The closed position 514 includes a opaque barrier portion 516. Preferably, the barrier portion 516 is just a solid block of material.

Figure 6A:
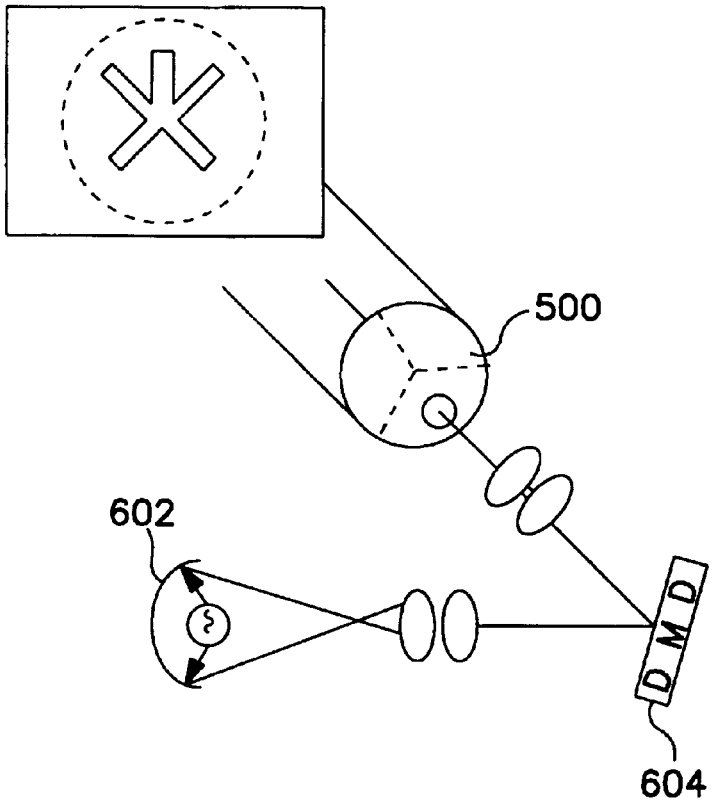
FIG. 6A shows an illumination device including a three position shutter according to a preferred embodiment of the present invention which is set to a mask position.

FIG. 6A shows a preferred embodiment of an illumination system. A shutter 500 of the type shown in FIG. 5 is rotatably mounted between a light source 602/DMD 604 such that substantially all the light from the light source 602 strikes only one section of the shutter 500 at a time. The shutter 500 is rotatably positioned to the mask position 504. Thus, when the light source 602 is activated, light from the light source 602 reflected by DMD 604 strikes only the mask position 504 of the shutter 500.

Using digital control signals, the DMD 604 is set so that an active portion 612 of the individual mirrors are turned "on" and an inactive portion 614 of the individual mirrors are turned "off" (see FIG. 4A). The shape of the active portion 612 is set to conform to the desired shape of the bright portion of the illumination reflected by the DMD 604 shown in FIG. 6B, described below.

Figure 6B:
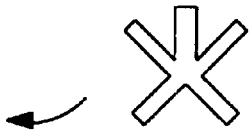
FIG. 6B shows an illumination pattern resulting from the device shown in FIG. 6A.

FIG. 6B shows an illumination pattern 620 generated by the illumination device 600 configured as shown in FIG. 6A.

Returning to FIG. 4A and 4B, when the shutter 500 is not interposed between the DMD 400 and the stage. All portions of the DMD 400 reflect the light and create the undesirable illumination pattern 410 shown in FIG. 4B. In particular, the bright circular area 414 is surrounded by an undesirable dim rectangular penumbra 418 and slightly brighter frame 422.

As described above, the illumination pattern 614 shown in FIG. 6B does not include a dim rectangular penumbra 418 and a slightly brighter frame 422. These undesirable projections are substantially eliminated by using the shutter 500 and the aperture 506. A dim penumbra illumination 628 is generated by light reflecting from the inactive portion 614 of the DMD 604. This dim circular penumbra illumination 628 is more desirable than the dim rectangular penumbra 418 and slightly brighter frame 422 of FIG. 4B because the shape of the dim penumbra illumination 628 is controlled by the shape of the aperture 506. Accordingly, the dim penumbra illumination 628 can be conformed to a desirable shape.

Figure 7:
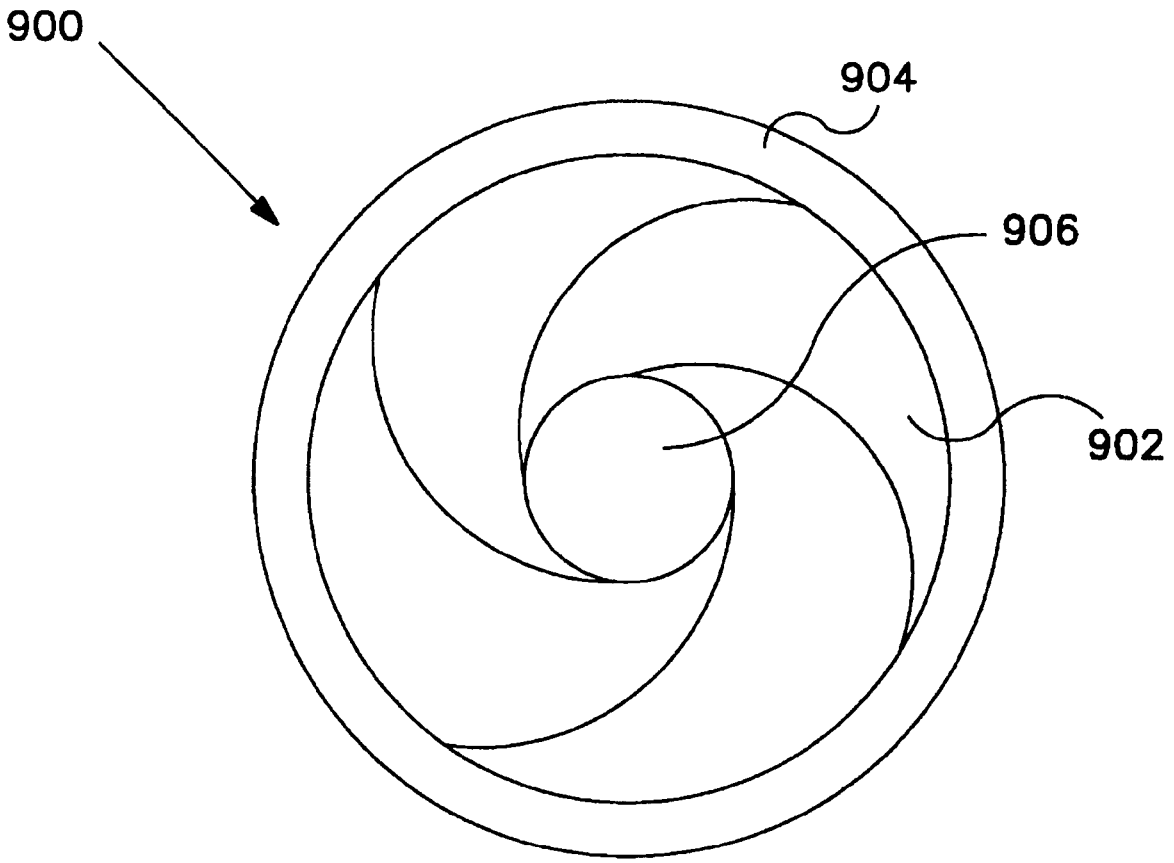
FIG. 7 shows an iris-type shutter.

FIG. 7 shows an alternate embodiment for an iris shutter 900. Preferably, a series of opaque plates 902 are arranged inside a ring 904 to form an iris diaphragm. By turning the ring 904 the plates 902 move so that an iris aperture 906 in the center of the iris shutter 900 varies in diameter. The iris aperture 906 preferably varies from closed to a desired maximum open diameter. Preferably the iris shutter 900 can transition from closed to a maximum diameter (or the reverse) in 0.1 seconds or less.

Figures 8A, 8B:
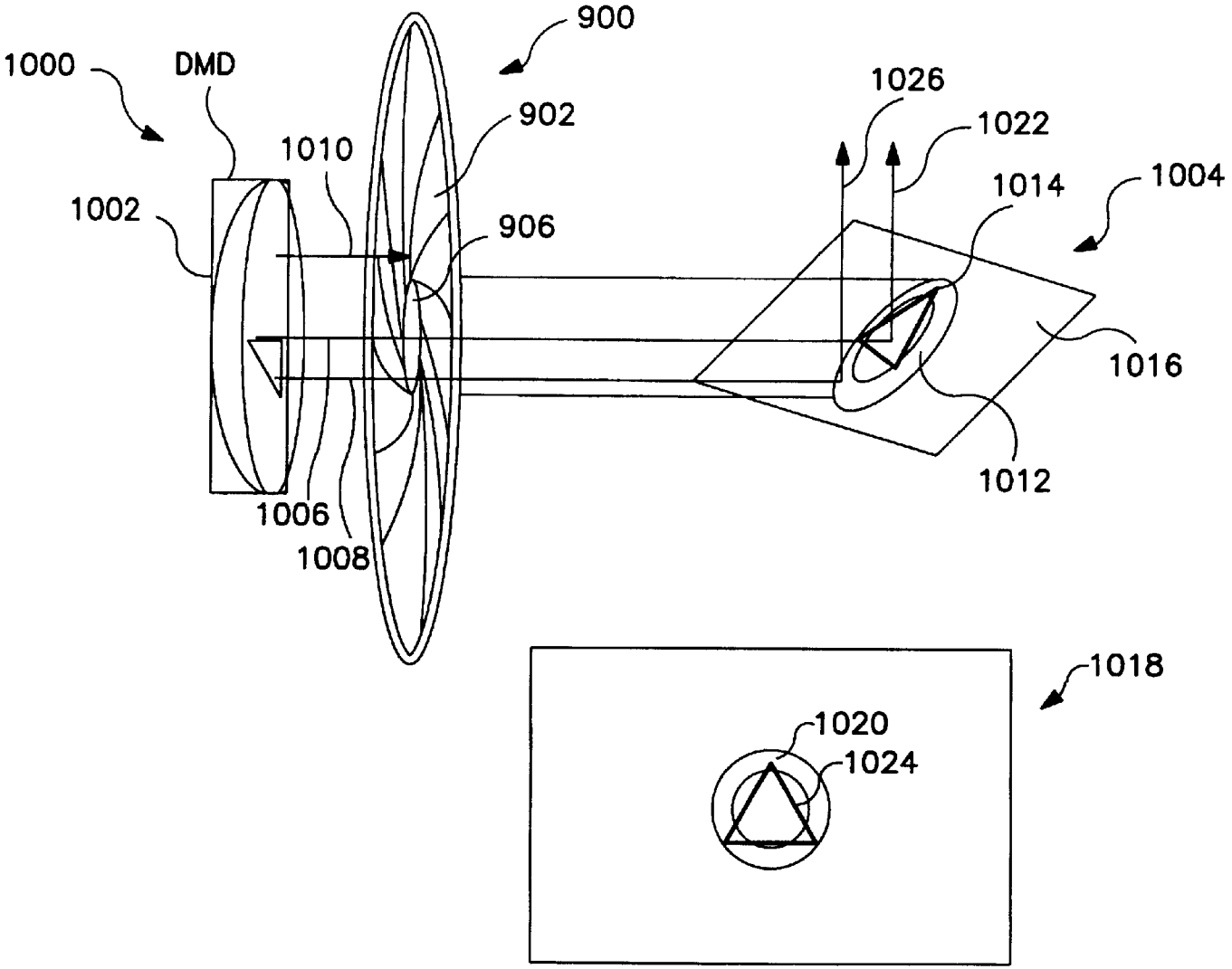
FIGS. 8A and 8B show use of the adjustable iris in a DMD system.

FIG. 8A shows an illumination device 1000 including an iris shutter 900 as shown. The iris shutter 900 is positioned between a DMD 1002 and a stage 1004. In FIG. 8A, the iris shutter 900 is partially open such that the iris aperture 906 allows part of the light 1006, 1008 from the light source 1002 to pass through, similar to the mask position 504 of the three position shutter 500 shown in FIG. 6A. One difference between the mask position 504 and the iris shutter 900 is that the iris aperture 906 is variable in diameter while the aperture 506 of the mask position 504 is fixed. The remainder of the light 1010 from the light source 1002 is blocked by the plates 902 of the iris shutter 900. The light 1006, 1008 which passes through the iris aperture 906 strikes the DMD 1004 in a pattern 1012 which is the same shape as the shape of the iris aperture 906. Through digital control signals, some of the individual mirrors of the DMD 1004 are turned "on" to form an active portion 1014, and some of the individual mirrors are turned "off" to form an inactive region 1016. Preferably, the pattern 1012 is at least as large as the active portion 1014 of the DMD.

FIG. 8B shows an illumination pattern 1018 generated by the illumination device 1000 shown in FIG. 8A. Similar to FIG. 6A and 6B, a bright illumination 1020 is generated by light 1022 reflected from the active portion 1014 of the DMD 1004. A dim penumbra illumination 1024 is generated by light 1026 reflected from the inactive portion 1016 of the DMD 1004. By varying the diameter of the iris aperture 906, the size of the pattern 1012 on the DMD 1004 changes. As the pattern 1012 changes the amount of the inactive portion 1016 of the DMD 1004 which is struck by light 1008 from the light source 1002 changes and so the dim penumbra 1024 changes as well.

Figure 9:
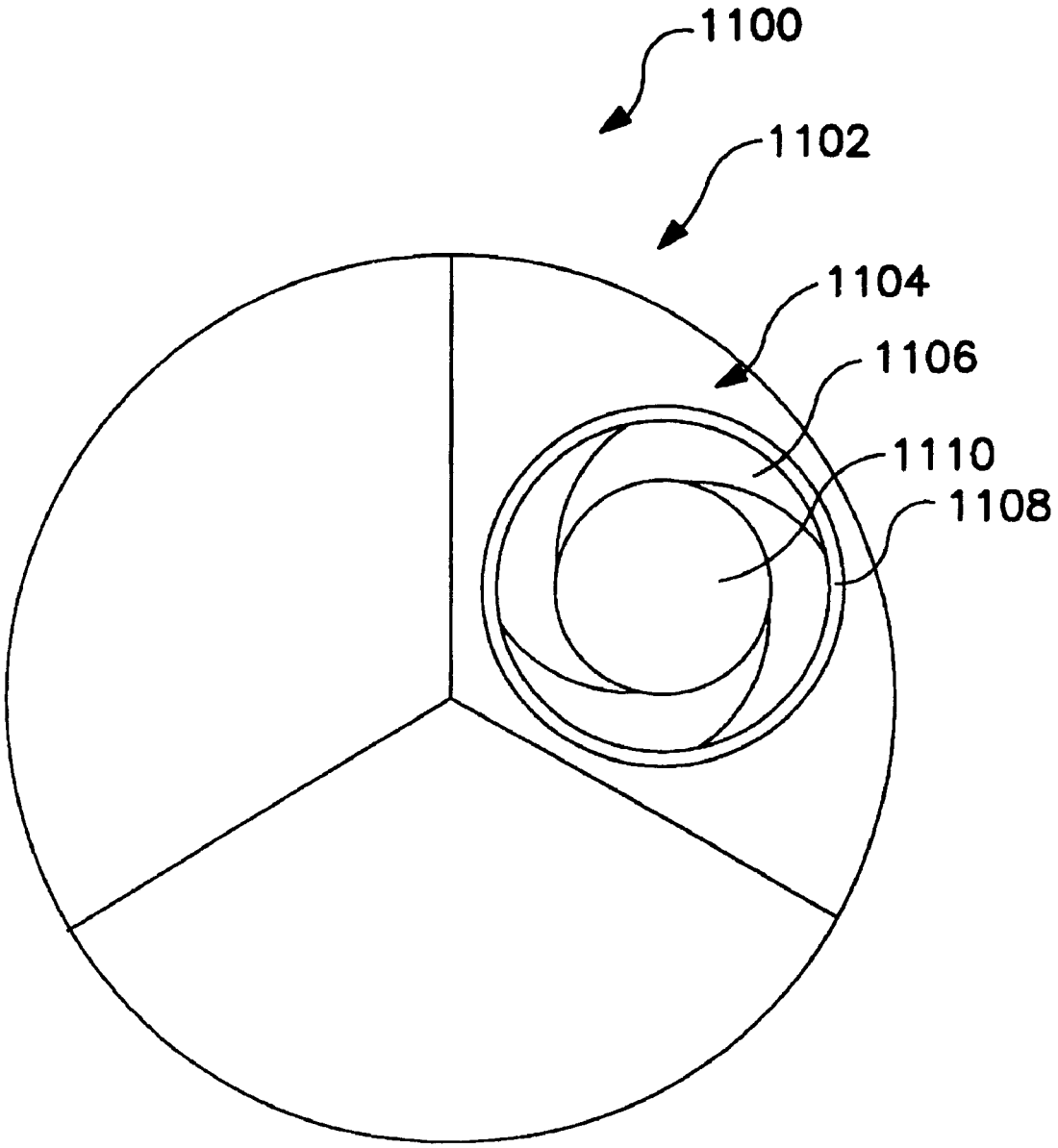
FIG. 9 shows a three-position shutter with an iris system.

FIG. 9 shows an alternate embodiment of a shutter 1100 which combines features of a three position shutter 500 with an iris shutter 900. The overall configuration of this shutter 1100 is that of the three position shutter 500. However, instead of the mask portion 504 as shown in FIG. 5 and FIG. 6A, one of the positions is an iris portion 1102. The iris portion 1102 has an iris diaphragm 1104 inserted into the material of the shutter 1100. Similar to the iris shutter 900 of FIG. 9, the iris diaphragm 1104 is made from a series of opaque plates 1106 arranged inside a ring 1108. By turning the ring 1108 the plates 1106 move so that an iris aperture 1110 in the center of the iris diaphragm 1104 varies in diameter. This configuration operates in most respects similarly to the three position shutter 500 as shown in FIG. 5 and FIG. 6A. Because of the iris diaphragm 1104, the amount of light blocked by the iris portion 1102 is variable.

Figure 10:
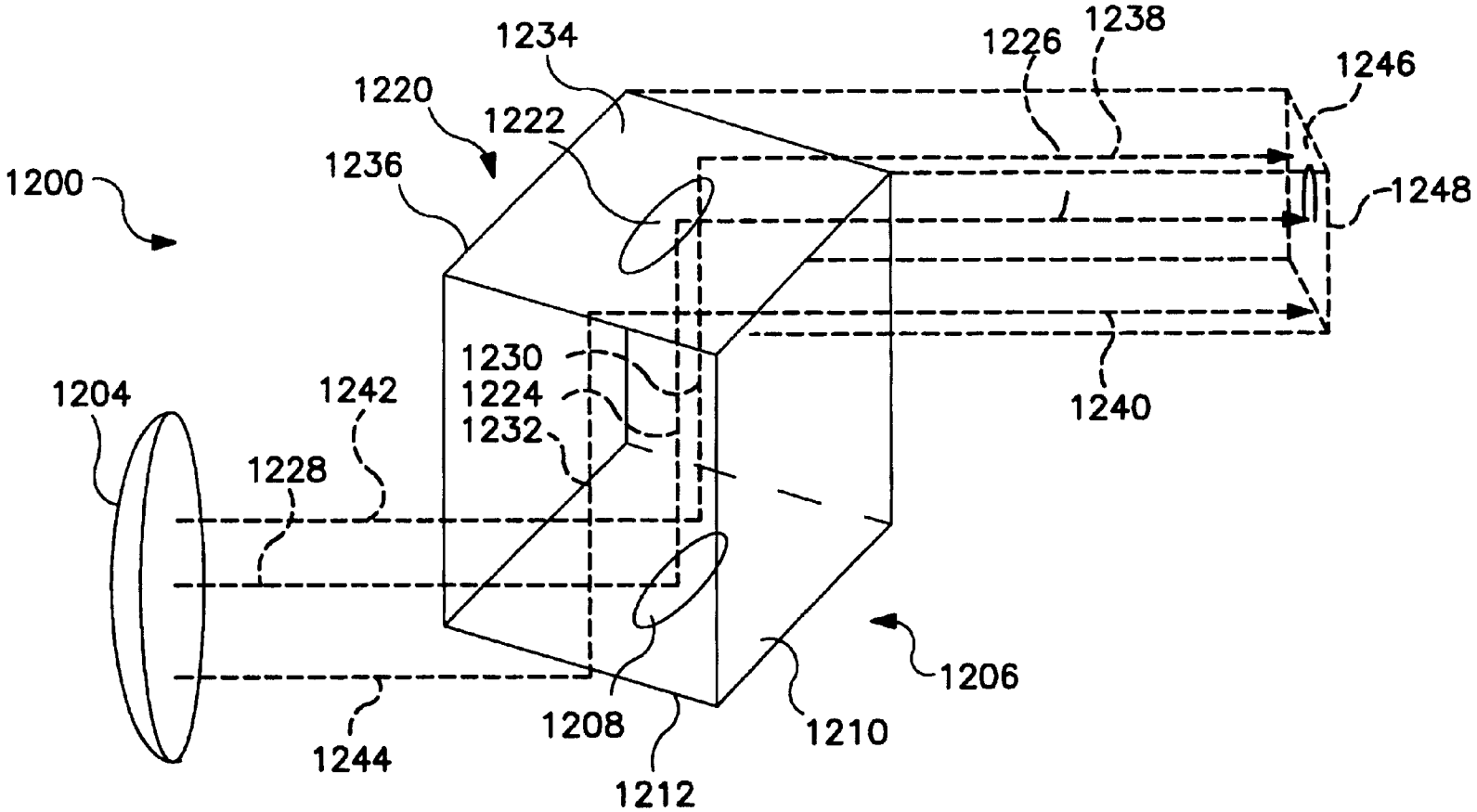
FIG. 10 shows an embodiment with a light.

FIG. 10 shows an alternate embodiment of an illumination device 1200 which includes a second reflective surface 1202. A light source 1204 projects light onto a DMD 1206 which has an active portion 1208 and an inactive portion 1210. Light reflects off the DMD 1206 and strikes the second reflective surface 1202. The second reflective surface 1202 acts to reduce the dim penumbra and frame created by the inactive portion 1210 and edge 1212 of the DMD 1206 (recall FIG. 4A and 4B).

In the embodiment shown in FIG. 10, the second reflective surface 1222 is a light sensitive surface such as an array of light trigger cells. Only light of a certain brightness is reflected. If the light striking a cell is insufficiently bright, substantially no light is reflected by that cell. Alternately, the second reflective surface 1202 may be made of a polymer material that only reflects or passes light of sufficient brightness. Light 1214 reflected from the active portion 1208 of the DMD 1206 is preferably bright enough to be reflected from the second reflective surface 1202. Light 1216, 1218 reflected from the inactive portion 1210 and the edge 1212 of the DMD 1206 is preferably not bright enough to be reflected from the second reflective surface 1202. Thus, only light 1214 from the active portion 1208 of the DMD 1206 will be reflected from the second reflective surface 1202. As described above, the undesirable dim rectangular penumbra 418 and slightly brighter frame 422 (recall FIG. 4B) would be created by light 1216, 1218 reflected from the inactive portion 1210 and edge 1212 of the DMD 1206. The second reflective surface 1202 does not reflect this dim light 1216, 1218 and so wholly eliminates the dim penumbra and frame from the resulting illumination.

A number of embodiments of the present invention have been described which provide controlled obscurement of illumination. Nevertheless, it will be understood that various modifications may be made without departing from the spirit and scope of the invention. For example, filters or lenses might be introduced to the illumination device 600 shown in FIG. 6A between the shutter 500 and the DMD 604. Alternately, the light source might be a video projection device or a laser.

While this disclosure describes blocking the light before impinging on the DMD, it should be understood that this same device could be used anywhere in the optical train, including downstream of the DMD. Preferably the blocking is at an out of focus location to soften the edge of the penumbra, but could be in-focus.

The light reflecting device could be any such device, including a DMD, a grating light valve ("GLV"), or any other arrayed reflecting device which has a non-circular shape.

All such modifications are intended to be encompassed in the following claims.

What is claimed is:

1. An illumination device comprising:

a light source producing a light beam;

an array of controllable reflectors which are adjustable in response to control signals to selectively change some aspect of reflection of said light beam, said array having an overall controllable shape which is non-circular, said array producing a shaped output light beam which is shaped based on said control signals; and a controllable obscurement device positioned between the light source and the output light beam said obscurement device having at least one shape of passing which is circular;

wherein said obscurement device is at a location that is out of focus in the output light beam.

2. The illumination device of claim 1 wherein said obscurement device is at a location that is in focus in the output light beam.

3. An illumination device comprising:

a light source producing a light beam;

an array of controllable reflectors which are adjustable in response to control signals to selectively change some aspect of reflection of said light beam, said array having an overall controllable shape which is non-circular, said array producing a shaped output light beam which is shaped based on said control signals; and a controllable obscurement device positioned between the light source and the output light beam said obscurement device having at least one shape of passing which is circular; and wherein said obscurement device includes a first sector which is solid, a second sector which is open, and a third sector which includes inner surfaces defining a circular aperture.

4. The illumination device of claim 3 wherein said obscurement device has outer surfaces defining a portion of a circle for said first and third sectors.

5. The illumination device of claim 4 further comprising a rotating element which rotates said obscurement device around a center of the circle defined by said outer surfaces.

6. A method of shaping a light beam, comprising:

applying light to an array of controllable reflectors, said array of controllable reflectors being arranged in a non-circular shape; and using said array to shape an output light beam by blocking at least a portion of unwanted light reflected by said array to form a circular outer border of said unwanted light;

wherein said blocking occurs at a location that will be out of focus in the output light beam.

7. The method of claim 6 wherein said array is a digital micromirror device.

8. The method of claim 6 wherein said array is a grating light valve.

9. A method of operating a shutter, comprising:

providing a 3-position shutter;

rotating said shutter to a first position where all light is passed;

rotating said shutter to a second position where no light is passed;

rotating said shutter to a third position where some, but not all, of the light is passed, said some light being in a circular shape and out of focus.

10. Shuttered gobo device, comprising:

a light source;

a control circuit, producing a control signal indicative of a desired gobo shape;

a rectangular controllable reflector, receiving said control signal, and reflecting a desired light part indicated by said control signal in a first direction and reflecting an outer undesired light part in another direction; and a circular light blocking element, blocking at least a portion of said undesired light part, and curving another portion of said undesired light part, said another portion having a circular outer shape; and wherein said light blocking element is at a position that is out of focus in an output light beam.

11. An illumination device comprising:

a light source producing a light beam;

an array of controllable reflectors which are adjustable in response to control signals to selectively change some aspect of reflection of said light beam, said array having an overall controllable shape which is a non-circular, said array producing a shaped intermediate light beam which is shaped into a desired gobo shape with an outer shape defined by said control signal; and an illumination output element producing an output light beam, said illumination output element positioned so that at least a portion of said shaped intermediate light beam strikes said illumination output element; and wherein said light blocking element is at a position that is out of focus in an output light beam.

* * * * *